US010835021B2

(12) United States Patent
Nguyen

(10) Patent No.: US 10,835,021 B2
(45) Date of Patent: Nov. 17, 2020

(54) MODULAR HAMMOCK ASSEMBLY

(71) Applicant: Benjamin Nguyen, Ocean Spring, MS (US)

(72) Inventor: Benjamin Nguyen, Ocean Spring, MS (US)

( * ) Notice: Subject to any disclaimer, the term of this patent is extended or adjusted under 35 U.S.C. 154(b) by 555 days.

(21) Appl. No.: 15/709,592

(22) Filed: Sep. 20, 2017

(65) Prior Publication Data

US 2019/0082816 A1 Mar. 21, 2019

(51) Int. Cl.
*A45F 3/24* (2006.01)
*A47C 17/84* (2006.01)

(52) U.S. Cl.
CPC ..... *A45F 3/24* (2013.01); *A47C 17/84* (2013.01)

(58) Field of Classification Search
CPC ..... A45F 3/22; A45F 3/24; A47C 17/84
See application file for complete search history.

(56) References Cited

U.S. PATENT DOCUMENTS 115,128 A * 5/1871 Southwick ..... A45F 3/24 5/130
209,275 A * 10/1878 Leycester ..... A45F 3/24 5/130
405,719 A * 6/1889 Sinclair ..... A45F 3/24 5/128
460,804 A * 10/1891 Welling ..... A45F 3/24 5/130
488,272 A * 12/1892 Else ..... A45F 3/24 5/130
907,687 A * 12/1908 Emmert ..... A45F 3/24 5/130
1,062,950 A * 5/1913 Boss ..... A45F 3/22 5/121
1,066,668 A * 7/1913 Sisbower ..... A45F 3/24 5/130
4,757,563 A * 7/1988 An ..... A45F 3/24 135/155
5,035,012 A * 7/1991 Westrich ..... A45F 3/24 403/377
5,046,203 A 9/1991 de Cuadros
D408,166 S 4/1999 Bayless
6,276,008 B1 * 8/2001 Chen ..... A45F 3/24 5/120
6,470,518 B1 * 10/2002 Ke ..... A45F 3/24 5/120

(Continued)

*Primary Examiner* — Robert G Santos
*Assistant Examiner* — Rahib T Zaman

(57) ABSTRACT

A modular hammock assembly for hanging a hammock includes a first frame support and a second frame support. Each of the first frame support and second frame support includes a coupler that has a lower end that is open and defines a receiving space. The first frame support and the second frame support include a pair of legs. Each pair of legs has a top end and a bottom end. Each of the top ends is removably extended into the receiving space. A support rod is releasably attached to and extends between the first frame support and second frame supports. A first bracket and a second bracket each attached to the support rod. The first bracket is positioned adjacent to the first frame support and the second bracket is positioned adjacent to the second frame support. A hammock is attached to and extending between the first bracket and second bracket.

1 Claim, 5 Drawing Sheets

(56) References Cited

U.S. PATENT DOCUMENTS

| | | | | |
|---|---|---|---|---|
| 7,861,337 | B1 * | 1/2011 | Patel | A47D 9/02 5/101 |
| 7,895,686 | B1 | 3/2011 | Chen | |
| 8,806,676 | B2 | 8/2014 | Reeb et al. | |
| 10,441,060 | B1 * | 10/2019 | Pinholster, Jr. | A47C 9/105 |
| 2007/0017026 | A1 | 1/2007 | Lam | |
| 2014/0152063 | A1 * | 6/2014 | Huang | A45F 3/24 297/273 |
| 2016/0106200 | A1 | 4/2016 | Brinkley et al. | |

* cited by examiner

MODULAR HAMMOCK ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art including information disclosed under 37 CFR 1.97 and 1.98

The disclosure and prior art relates to modular hammock devices and more particularly pertains to a new modular hammock device for hanging a hammock.

BRIEF SUMMARY OF THE INVENTION

An embodiment of the disclosure meets the needs presented above by generally comprising a first frame support and a second frame support. Each of the first frame support and second frame support includes a coupler that has a lower end. The lower end is open and defines a receiving space. The first frame support and the second frame support each include a pair of legs. Each pair of legs has a top end and a bottom end. Each of the top ends is removably extended into the receiving space. A support rod is releasably attached to and extends between the first frame support and second frame supports. A first bracket and a second bracket each attached to the support rod. The first bracket is positioned adjacent to the first frame support and the second bracket is positioned adjacent to the second frame support. A hammock is attached to and extending between the first bracket and second bracket.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
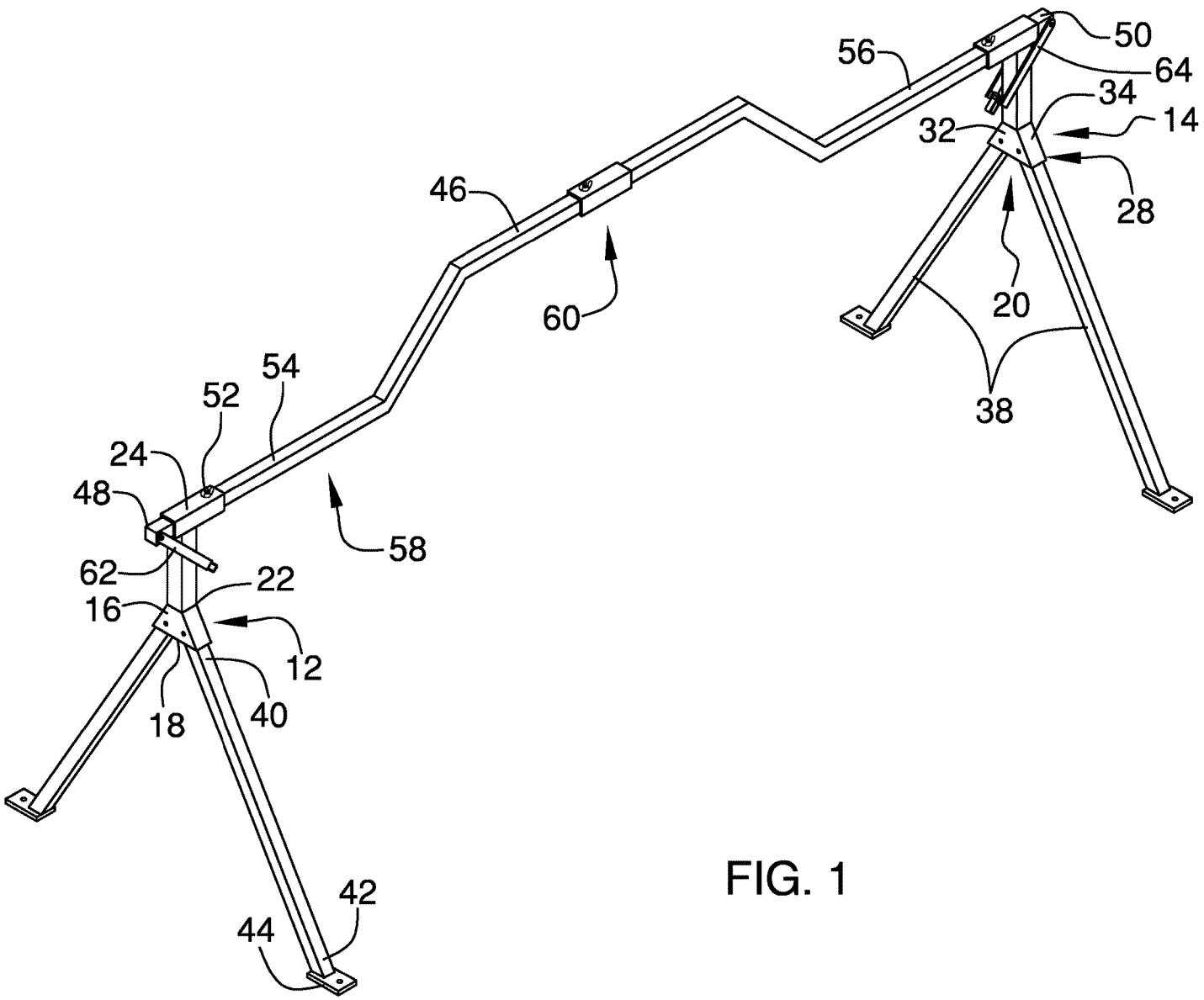
FIG. 1 is a top side view of a modular hammock assembly according to an embodiment of the disclosure.
Figure 2:
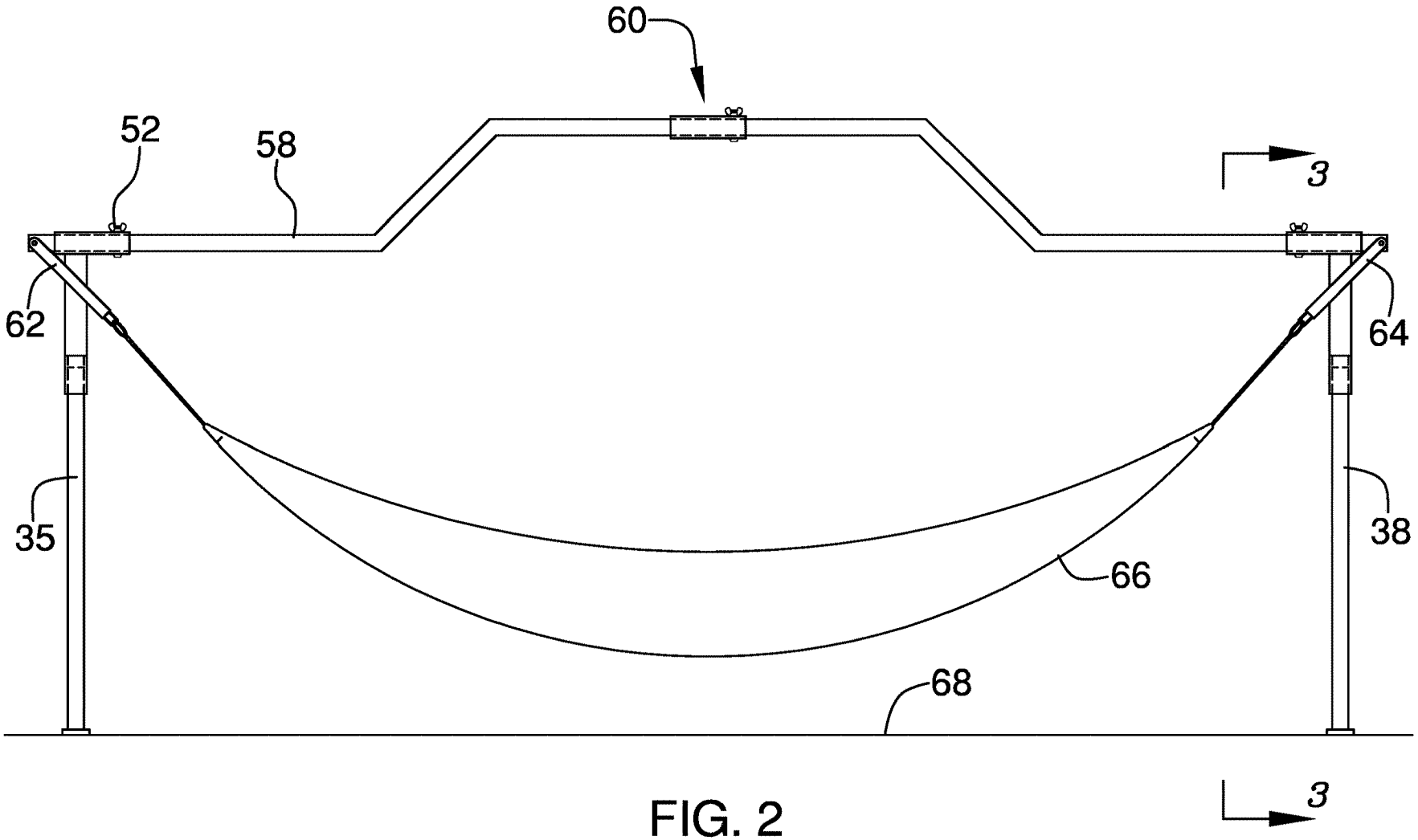
FIG. 2 is a front view of an embodiment of the disclosure.
Figure 3:
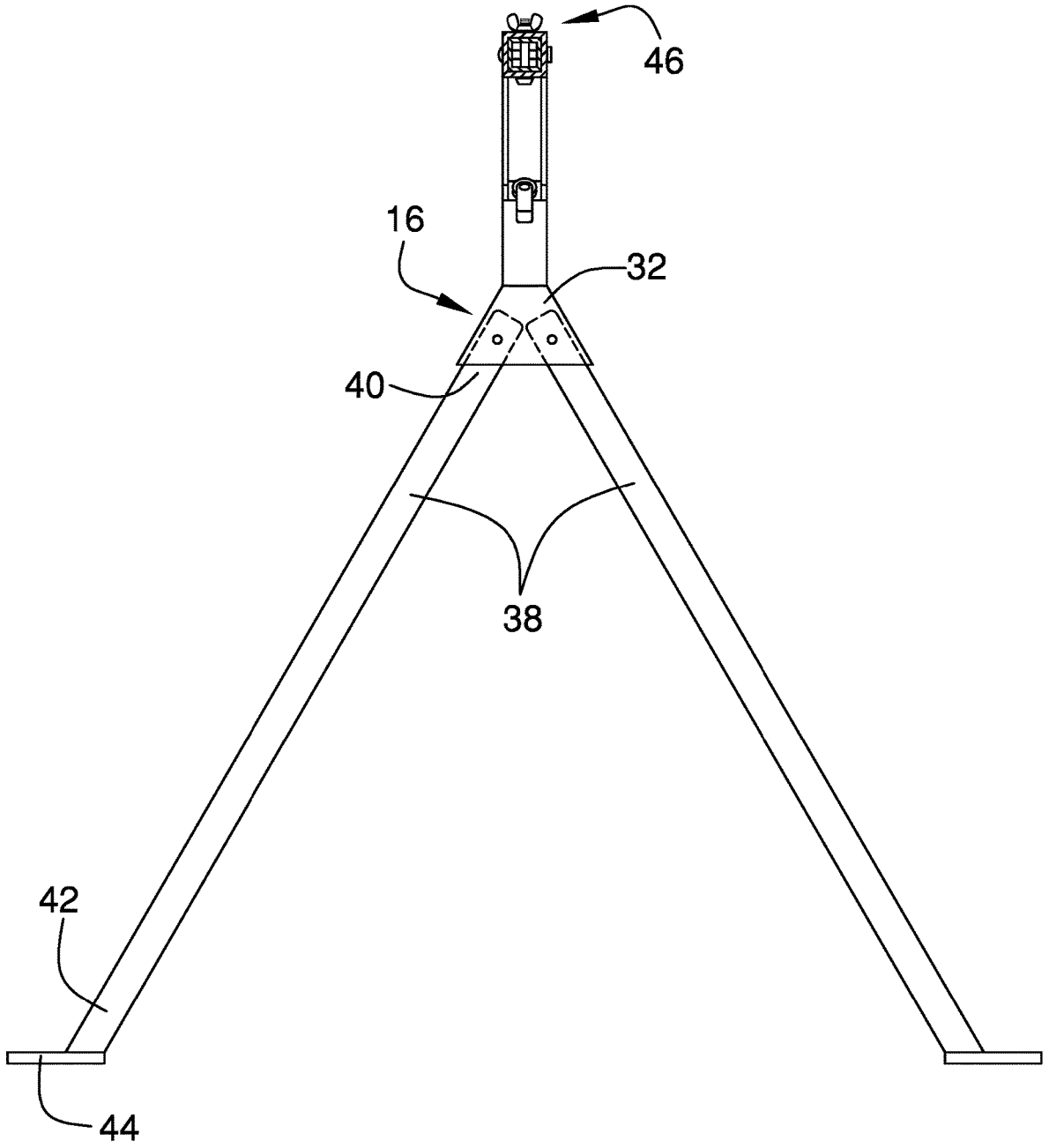
FIG. 3 is a side view of an embodiment of the disclosure.
Figure 4:
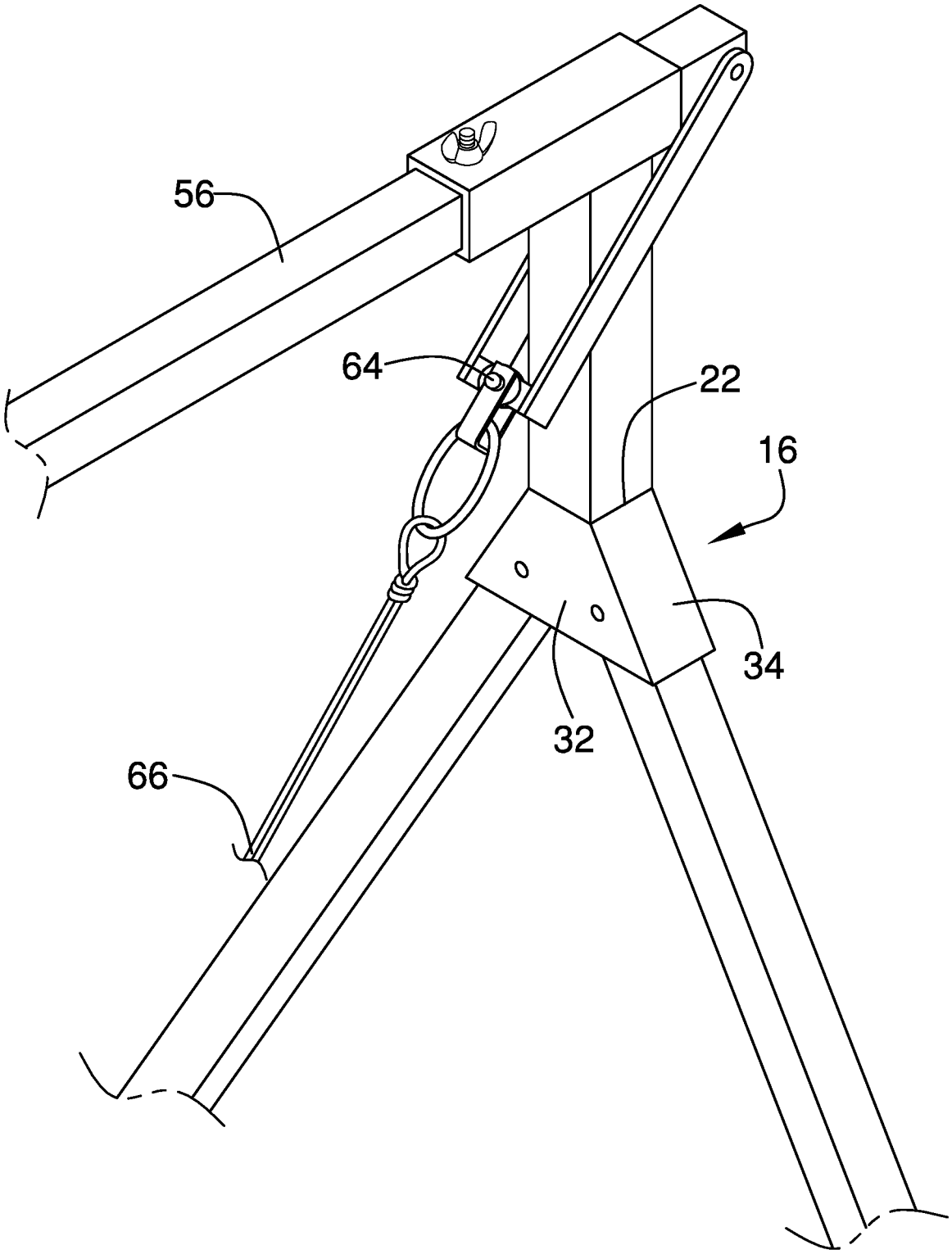
FIG. 4 is a front side view of an embodiment of the disclosure.
Figure 5:
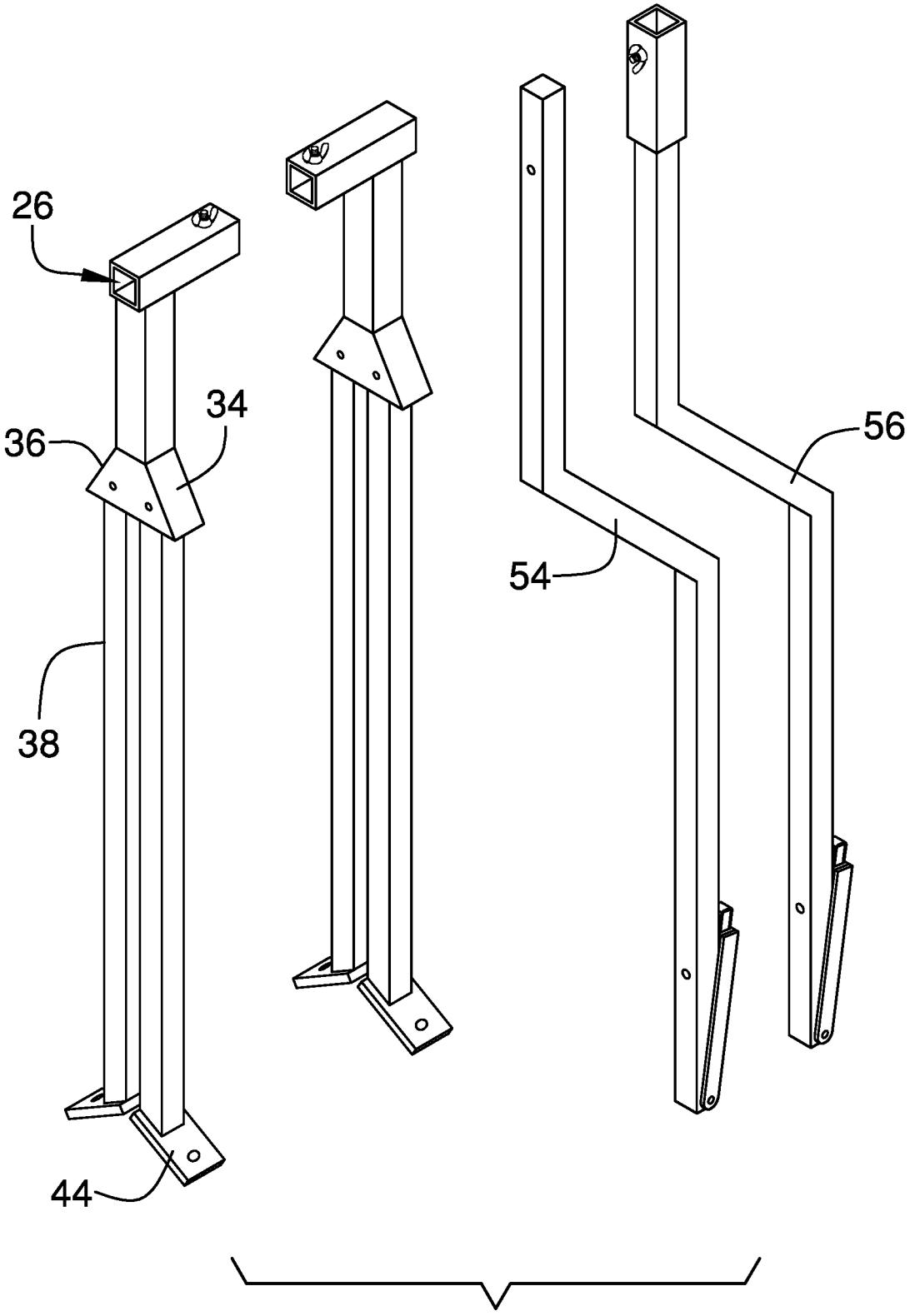
FIG. 5 is a perspective view of components of an embodiment of the disclosure.

With reference now to the drawings, and in particular to FIGS. 1 through 5 thereof, a new modular hammock device embodying the principles and concepts of an embodiment of the disclosure and generally designated by the reference numeral 10 will be described.

As best illustrated in FIGS. 1 through 5, the modular hammock assembly 10 generally comprises a first frame support 12 and a second frame support 14. The first frame support 12 and the second frame support 14 each include a coupler 16 that has a lower end 18. The lower end 18 is open and defines a receiving space 20. The coupler 16 includes an upper end 22 positioned opposite of the lower end 18. The upper end 22 comprises a sleeve 24 that has a laterally disposed opening 26 that extends therein. The coupler 16 includes a perimeter wall 28 that extends upwardly from the lower end 18. The perimeter wall 28 includes an inner wall 30, an outer wall 32, a first side wall 34 and a second side wall 36. The first side wall 34 and second side wall 36 taper towards each other as the perimeter wall 28 extends upwardly from the lower end 18.

The first frame support 12 and the second frame support 14 each include a pair of legs 38 that have a top end 40 and a bottom end 42. Each of the top ends 40 removably extends into the receiving space 20. The legs 38 are each hingedly coupled to the coupler 16. The legs 38 are positionable in a stored position abutting each other or in a deployed position angled away from each other as the legs 38 extend downwardly from the coupler 16. The legs 38 lie in the same plane with respect to each other. The sleeve 24 is orientated perpendicular to the plane of the legs 38. A pair of feet 44 is provided and each of the bottom ends 42 has one foot 44 of the pair of feet 44 attached thereto. The feet 44 are angled away from each other, such that the feet 44 provide support to the legs 38 in the deployed position. The first frame support 12 and the second frame support 14 may be comprised of steel, aluminum, fiber glass or other load bearing material.

A support rod 46 is releasably attached to and extends between the first frame support 12 and the second frame support 14. The support rod 46 has a first end 48 and a second end 50. The first end 48 and the second end 50 extend through a corresponding one of the sleeves 24. A pair of pins 52 extends through the sleeves 24 and the support rod 46 to retain the support rod 46 in engagement with the first frame support 12 and the second frame support 14. The support rod 46 has a break therein to define a first section 54 and a second section 56 of the support rod 46. The first section 54 and the second section 56 are releasably coupled together. The support rod 46 has a pair of outer portions 58 and a middle portion 60. The middle portion 58 is angled upwardly from the outer portions 58.

A first bracket 62 and a second bracket 64 are attached to the support rod 46. The first bracket 62 is positioned adjacent to the first frame support 12 and the second bracket 64 is positioned adjacent to the second frame support 14. The first frame support 12 and the second frame support 14 are positioned between the first bracket 62 and the second bracket 64 and the middle portion 60 of the support rod 46. A hammock 66 is attached to and extends between the first bracket 62 and the second bracket 64.

In use, the first section 54 and the second section 56 of the support rod 46 are coupled. The support rod 46 is attached to the first frame support 12 and the second frame support 14 through their corresponding sleeves 24. Each pair of legs 38 is positioned in the deployed position. A hammock 66 is attached to the first bracket 62 and the second bracket 64, such that the hammock 66 is held over a surface 68. A user can then lie in the hammock 66.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modular hammock assembly comprising:

a first frame support and a second frame support, each of said first and second frame supports including:

a coupler having a lower end being open and defining a receiving space, said coupler including an upper end positioned opposite of said lower end, said upper end comprising a sleeve having a laterally disposed opening extending therein, said coupler including a perimeter wall extending upwardly from said lower end, said perimeter wall including an inner wall, an outer wall, a first side wall and a second side wall, said first and second side walls tapering towards each other as said perimeter wall extends upwardly from said lower end;

a pair of legs each having a top end and a bottom end, each of said top ends being removably extended into said receiving space, said legs each being hingedly coupled to said coupler, said legs being positionable in a stored position abutting each other or in a deployed position angling away from each other as said legs extend downwardly from said coupler, said legs lying in same plane with respect to each other, said sleeve being orientated perpendicular to said plane of said legs;

a pair of feet, said bottom end of each leg of said pair of legs having one foot of said pair of feet being attached thereto, said feet being angled away from each other;

a support rod being releasably attached to and extending between said first and second frame supports, said support rod having a first end and a second end, said first and second ends extending through a corresponding one of said sleeves, a pair of pins extending through said sleeves and said support rod to retain said support rod in engagement with said first and second frame supports, said support rod having a break therein to define a first section and a second section of said support rod said first and second sections being releasably coupled together, said support rod having a pair of outer portions and a middle portion, said middle portion being angled upwardly from said outer portions;

a first bracket and a second bracket each being attached to said support rod, said first bracket being positioned adjacent to said first frame support and said second bracket being positioned adjacent to said second frame support, said first and second frame supports being positioned between said first and second brackets and said middle portion of said support rod; and a hammock being attached to and extending between said first and second brackets.

* * * * *